United States Patent [19]

Saurwein

[11] Patent Number: 4,747,758

[45] Date of Patent: May 31, 1988

[54] FLUID PRESSURE-INTENSIFIER

[76] Inventor: Albert C. Saurwein, 5 F St. SE., Auburn, Wash. 98002

[21] Appl. No.: 846,039

[22] Filed: Apr. 17, 1986

[51] Int. Cl.[4] ..... F04B 35/00

[52] U.S. Cl. ..... 417/397; 91/275

[58] Field of Search ..... 91/275; 417/397, 396, 417/393

[56] References Cited

U.S. PATENT DOCUMENTS

| | | | |
|---|---|---|---|
| 2,949,098 | 8/1960 | Flick | 91/275 X |
| 3,070,023 | 12/1962 | Glasgow | 417/397 |
| 3,382,770 | 5/1968 | Berninger et al. | 91/275 |
| 3,771,912 | 11/1973 | Conlee | 417/397 |
| 4,382,750 | 5/1983 | Robertson et al. | 417/397 |

FOREIGN PATENT DOCUMENTS

| | | | |
|---|---|---|---|
| 3018625 | 11/1981 | Fed. Rep. of Germany | 417/397 |

*Primary Examiner*—Leonard E. Smith

*Attorney, Agent, or Firm*—Harry M. Cross, Jr.

[57] ABSTRACT

A fluid pressure-intensifying apparatus of the double-acting type has an elongated cylindrical housing that encloses the low pressure and high pressure chambers and compressively position and restrains the elements that make up the low and high pressure chambers under operating conditions. Hydraulic working fluid 4-way control valve solenoids are actuated by an actuating piston assembly mounted in fluid communication with the low pressure working fluid chamber.

12 Claims, 1 Drawing Sheet

FLUID PRESSURE-INTENSIFIER

FIELD OF THE INVENTION

This invention relates to high pressure fluid intensifier systems. More particularly, this invention relates to double-acting hydraulic intensifiers.

BACKGROUND OF THE INVENTION

In a typical high pressure fluid intensifier system, hydraulic fluid acts on a reciprocating double-acting, low pressure—high pressure piston assembly to compress water to several thousand psi. The piston assemblies of such systems are exposed to hydraulic fluid pressures on the order of 3,000 psi and to water pressures on the order of 20–60,000 psi. These assemblies must be designed to withstand tremendous pressure fluctuations while at the same time maintain hydraulic fluid/water separation.

The pressure chambers within which such a piston assembly works, and the various pressure seals incorporated in the assembly are severely stressed. The pressure chambers are often made up of members that are screwed and/or bolted together to resist cyclic pressure buildup and release. Replacement of the high pressure seals periodically is difficult because of the attachment of the various members making up the intensifier pressure chambers and piston assembly. Usually, the intensifier must be completely dismantled to reach and repair or replace internal elements.

SUMMARY OF THE INVENTION

The intensifier of this invention comprises an assembly having a central low pressure chamber flanked at each side by a high pressure chamber axially aligned with the low pressure chamber, a low pressure—high pressure piston assembly contained within the pressure chambers, a housing containing the axially-aligned pressure chambers, inlet/outlet valve-mounting end retainers screwed into each end of the housing to position and secure the internal elements making up the pressure chambers, and inlet/outlet valve bodies mounted by the end retainers in fluid communication with the adjacent high pressure chambers. The entire assembly fits together in such a way that removal of the end retainers permits easy disassembly and repair or replacement of worn parts. Portions of the housing may be cut away to afford access to the elements making up the pressure chambers. Within these access openings, low pressure fluid fittings may be extended for fluid communication with the low pressure chamber.

Another aspect of the invention is the provision of a low pressure fluid control valve actuator. This actuator involves a piston assembly, in fluid communication with the low pressure chamber, coupled to an external limit switch. Two such activators are provided, one on each side of the low pressure chamber, for actuating the low pressure fluid control valve. The piston assembly of each actuator extends into one end of the low pressure chamber and is shifted by the low pressure piston to activate the external limit switch and effect a change in the flow direction of the low pressure fluid. As a consequence, the low pressure piston will be moved out of contact with the actuator piston and low pressure fluid will act on the piston to extend it back into the low pressure chamber and out of contact with the external limit switch. As the low pressure piston travels to the opposite side of the low pressure chamber, the process will be duplicated with respect to the other low pressure fluid control valve actuator. These actuators are mounted by cylinder blocks that also define the adjacent end boundaries of the low and high pressure chambers. The activators are accessible through housing cut outs.

DESCRIPTION OF THE INVENTION

Figure 2:
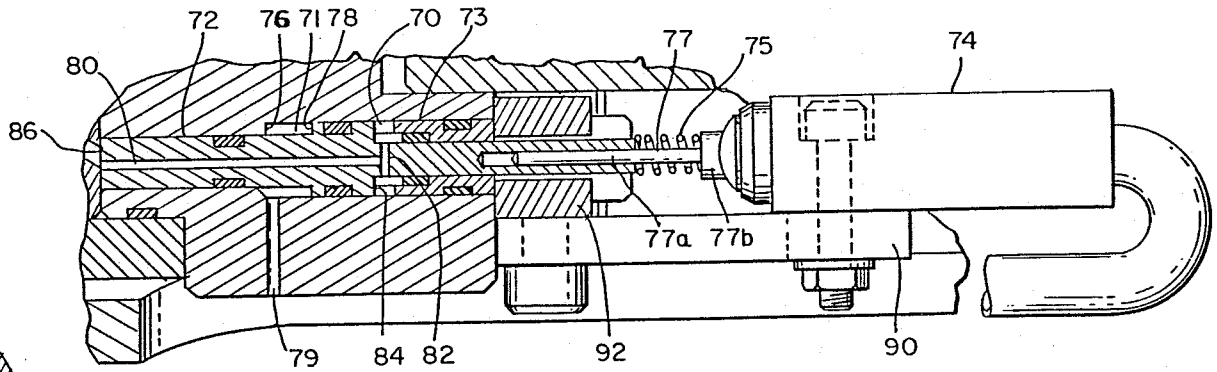
FIG. 2 is an enlarged front elevation of a portion of the FIG. 1 intensifier in partial cross-section.
Figure 1:
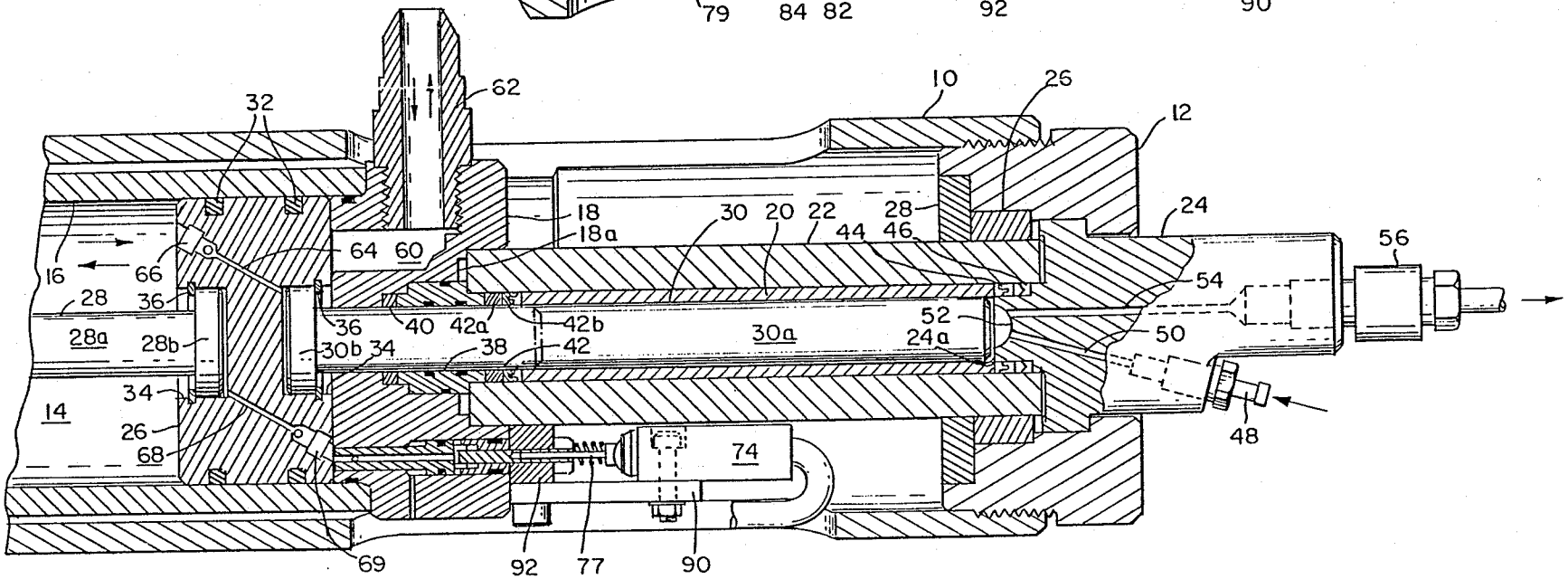
FIG. 1 is a front elevation of the right half of the intensifier of this invention in partial cross section.

The intensifier of this invention utilizes hydraulic fluid (oil) to drive a high pressure—low pressure piston assembly to produce a high pressure water flow. The intensifier shown in FIG. 1 is double-acting. It comprises a housing 10 in the form of an elongated steel cylinder. One half, the right half, is shown in FIG. 1. The left half is a duplicate. Each end of the housing mounts an end retainer ring 12, the end of housing 10 being internally threaded to mate with external threads on end retainer ring 12 as shown. Within housing 10, a low pressure chamber 14 is provided by a steel cylinder 16 fitted onto a cylindrical end cap 18 at each end (the right hand cap being shown; the left hand end cap is an opposite hand duplicate). Also within housing 10, a left hand and a right hand high pressure chamber are provided (the right hand high pressure chamber 20 being shown; the left hand high pressure chamber is a duplicate), each by an elongated steel barrel cylinder 22 fitted at its inner end into end cap 18 and at its outer end onto a valve body 24 of an inlet/outlet water check valve assembly. Sleeve and ring bearings, 26 and 28, center the outer end of barrel cylinder 22 in end retainer 12.

The outer surface of end cap 18 conforms to the inner surface of housing cylinder 10, with a small allowance for a slip-fit clearance. Tightening the end retainers 12 places the pressure chamber elements in longitudinal compression and the housing cylinder 10 in longitudinal tension. When one or both end retainers 12 are removed, however, these elements may be removed from the housing in a very expeditious manner. The low pressure and high pressure cylinders, 16 and 22, are mounted in axial alignment with the housing cylinder 10 by the end caps 18 and the retainer rings 12. Because of the relative dimensions of the elements thus far described, the pressure chamber elements are confined against any lateral or longitudinal movement.

The low pressure—high pressure piston assembly comprises a low pressure piston 26 and left and right hand high pressure pistons 28 and 30. The low pressure piston is a cylindrical disk contained within low pressure chamber 14. Its outer surface conforms to the inner surface of low pressure cylinder 16, with a small allowance for a slip-fit clearance, and mounts appropriate hydraulic pressure seals 32 to seal one side of low pressure chamber 14 from the other. The high pressure pistons are connected to opposite faces of the low pressure piston 26 and extended through the respective cylinder block 18 into high pressure chamber sleeve 20.

Each high pressure piston is a one piece element machined to provide an elongated solid cylindrical rod **30*a* having a diameter slightly smaller than the inside diameter of sleeve 20**, and to provide a cylindrical flange 30*b* at its inner end having a diameter larger than its rod. The high pressure piston flange 30*b* is fitted within a cylindrical counter bore 34 machined in the respective face of the low pressure piston 26. The flange 30*b* is held in place by a retaining ring 34, the latter being retained in a groove machined in the counterbore for that purpose. The cylindrical passage in end cap 18, through which the high pressure piston rod 30*a* extends, has a diameter slightly larger than the piston rod diameter. The high pressure side of the cylinder block 18 is machined to provide a stepped cylindrical counterbore 18*a* of inwardly-reducing diameters, the outermost portion to fit high pressure cylinder 22, the middle to fit a cylindrical piston rod centering ring 38, and the innermost to fit an appropriate high pressure static seal 40.

The centering ring 38 is machined to provide a middle portion that conforms to the diameter of the middle portion of counterbore 18*a* and an inner extension that conforms to the diameter of the innermost portion of counterbore 18*a*. The inner extension of centering ring 38 bears against and retains hydraulic seal 40 in place. Centering ring 38 also has an outer extension that extends outward beyond the middle portion of counterbore 18*a* and conforms to the inner diameter of high pressure cylinder 22. The high pressure cylinder 22 is abuts the outermost portion of counterbore 18*a* in load bearing contact, and also abuts the outer extension of centering ring 38 to hold it in position. The reactive hydraulic force of the fluid working in low pressure chamber 14 is transmitted through the end cap 18 and high pressure cylinder 22 into the end retainer 12 and the internal threads of housing cylinder 10.

The centering ring 38 is made of a non-ferrous metal, such as beryllium-copper or an aluminum-nickle-bronze alloy. It serves as a bushing for the high pressure piston rod 30*a* as well as a retainer for hydraulic seal 40. It also holds high pressure cylinder 22 concentric with high pressure piston rod 30*a*. It also provides a metal back up for a high pressure dynamic seal group 42.

The opposite end of high pressure cylinder 22 fits over a stub that protrudes from the check valve body 24. Valve body 24 is machined to provide a cylindrical stub 24*a* for that purpose. The end of the stub is machined to provide a smaller cylindrical end surface as a seat for a high pressure dynamic seal group 44. The stepped transition between the high pressure cylinder—mounting stub and the high pressure seal seat provides a metal back up for seal group 44. The end diameter of stub 24*a* corresponds to the diameter of high pressure piston rod 30*a* as shown.

High pressure piston rod 30*a* reciprocates within the sleeve 20 inside of the cylinder 22 between the position shown and a position indicated by the dotted line adjacent seal group 42 that depicts the end of piston rod 30 in full retracted position. Seals groups 42 and 44 maintain the high pressure integrity within cylinder 22 as piston rod 30*a* reciprocates back and forth. Seal group 42 comprises a DELRIN dynamic back-up seal ring 42*a* that abuts center ring 38 and a polyurethane lip type seal 42*b*. Seal group 44 is composed of the same commercial lip seal 44*a* abutting a DELRIN ring 44*b* in turn abutting a non ferrous back up ring 44*c*.

As high pressure piston rod 30*a* is retracted from the position shown, low pressure water is drawn into high pressure chamber 20 through an inlet check valve 48, mounted by valve body 24, with passage 50 to valve body opening 52. When piston rod 30*a* is driven back to the position shown, inlet check valve 48 closes, water is compressed to a high pressure and then forced out through valve body opening 52, outlet passage 54 and through outlet check valve 56, mounted by valve body 24.

Reciprocation of the high pressure piston is effected as a consequence of hydraulic fluid being pumped into low pressure chamber 14 on one side of low pressure piston 26 or the other. Each end cap 18 is ported as at 60 to provide for hydraulic fluid flow into and out of low pressure chamber 14. An inlet tube 62 is screwed into port 60 for connection to a hydraulic fluid supply. When hydraulic fluid is pumped through port 60 into chamber 14, low pressure piston will be driven leftward from the position shown, thus retracting the right hand high pressure piston rod 30*a* and extending the left hand high pressure piston rod 28*a*. Concurrently, hydraulic fluid will be vented through the hydraulic fluid port in the left hand cylinder block, and water in the left hand high pressure chamber will be compressed and forced out through the left hand valve body. When low pressure piston 26 reaches the left end of low pressure chamber 14, hydraulic fluid flow will be reversed and low pressure piston 26 will be driven rightward. Hydraulic fluid will be vented through right hand cylinder block port 60 and water in high pressure chamber 20 will be compressed and forced out through valve body 24.

As low pressure piston 26 reciprocates, hydraulic fluid will accumulate between high pressure piston flange 30*b* and the low pressure piston counterbore 34. To prevent undue pressure buildup behind flange 30*b*, the base of counterbore 34 is vented through vent passage 64 and check valve 66 to the opposite side of the low pressure piston 26. High pressure piston flange 28*b* and its mating counterbore 34 are likewise vented through vent passage 68 and check valve 69. By this arrangement, a relatively loose fit can exist between the high pressure piston flanges and their respective counterbore seats, and the high pressure pistons can be easily retained by their respective counterbore seat snap rings 36.

A limit switch 74 for signaling a hydraulic fluid control valve is mounted adjacent each end cap 18. The signal condition of each switch is affected by the reciprocal movement of an actuator piston assembly which is slidably mounted in the adjacent cylinder block 18 as shown. It is contemplated that a solenoid-operated 4-way directional control valve will be provided to control hydraulic fluid flow into and out of low pressure chamber 14. Each limit switch 74 would actuate one of two control valve solenoids.

With respect to the right hand assembly shown, rightward travel of an actuator shifter pin 72 toward the outer side of end cap 18 is effected by mechanical contact with low pressure piston 26, and leftward travel of shifter pin 72 toward the inner side of end cap 18 is effected by hydraulic fluid from low pressure chamber 14.

When low pressure piston 26 begins to travel leftward from the position shown, hydraulic fluid will enter chamber 70 and force shifter pin 72 leftward to effect a change in the signal condition of limit switch 74. Chamber 70 is defined between shifter pin 72, a seal ring 73 and a cylindrical passage provided in end cap 18. This passage has an outer portion of larger diameter than its inner portion, and the stepped surface 86 between them provides a stop to limit the leftward travel of shifter pin 72. Shifter pin 72 comprises a cylindrical member that is machined to the configuration of the passage and has a smaller diameter inner end portion and a large diameter middle portion with the stepped surface 78 between them provided to engage surface 76 to limit leftward travel of the pin. Shifter pin 72 has a smaller diameter outer end portion that extends through seal ring 73 toward limit switch 74 and mounts limit switch actuating plunger 77.

Shifter pin 72 contains an axial passage 80 extending from its inner end and an interconnecting diametral passage 82 providing fluid communication between low pressure chamber 14 and chamber 70. The stepped surface 84 between the middle portion and the smaller diameter outer portion of shifter pin 72 provides a piston face 84. The diameter of the pin outer portion is sufficiently reduced so that the area of piston face 84 is greater than the area of the inner pin end 86. When piston 26 travels leftward from the position shown, hydraulic fluid from low pressure chamber 14 enters chamber 70 through passages 80 and 82 in shifter pin 72. The hydraulic fluid in chamber 70 acts against piston face 84. Because the area of piston face 84 is greater than the area of the inner end 86 of shifter pin 72, the hydraulic fluid in chamber 70 will drive shifter pin 72 leftward, until travel of shifter pin 72 is stopped by contact between the stepped surface 78 and surface 76 in end cap 18. When piston 26 is reversed and travels rightward to the position shown, piston 26 will contact the protruding piston pin end 86 and drive the pin rightward to the position shown. The chamber 71 between stepped surfaces 76 and 78 is vented through passage 79 to the ambient atmosphere. The inner and middle portions of shifter pin 72 are provided with appropriate hydraulic fluid seals as shown to substantially prevent hydraulic fluid from entering chamber 71.

Plunger 77 comprises an elongated rod **77*a* loosely fitted within an axial passage provided in the outer portion of pin 72. The outer end of plunger 77 is capped by a switch contact 77*b*. A coil spring 75 extends between the end of the pin outer portion and plunger contact 77*b* to urge plunger 77 rightward. As piston 26 drives shifter pin 72 rightward to the position shown, spring 75 is compressed and urges plunger 77 into effective contact with limit switch 74. When piston 26 travels leftward and pin shifter 72 is driven leftward from the position shown, shifter pin 72 travels relatively to plunger 77. This relative movement relieves the compressive force on spring 75 and permits plunger 77 to release from effective contact with limit switch 74. The loose, sliding connection between pin 72 and plunger 77 affords some leeway in the positioning of switch 74 during installation and protects the limit switch from damage if pin 72** should overtravel.

By providing a cutout in housing 10 as shown, limit switch 74 can be mounted within the confines of housing 10 and still be accessible. Switch 74 is bolted to a mounting bracket 90. Bracket 90 is bolted at one end to a mounting plate 92 which itself is bolted to end cap 18. Mounting plate 92 has a passage machined through it that fits over the outer end portion of pin shifter 72. Mounting plate 92 also closes the outer end of the actuator pin passage provided in end cap 18, and abuts the outer end of sealing ring 73 to hold it in place against the reactive force of hydraulic fluid acting in chamber 70.

While a preferred embodiment of an intensifier, made in accordance with the principles of the present invention, has been described and illustrated, certain changes may be made without departing from the scope of the invention.

What is claimed is:

1. A fluid pressure-intensifying apparatus which comprises a low pressure—high pressure cylinder means providing a cylindrical low pressure chamber, a pair of elongated cylindrical high pressure chambers and a pair of low pressure chamber and caps defining opposite ends of said low pressure chamber, each end cap being provided with a bore in which an actuating piston extends, the high pressure chambers extending from opposite ends of said low pressure chamber; low pressure—high pressure piston means having a double acting low pressure piston section mounted for reciprocal movement in said low pressure chamber, and having a pair of elongated high pressure piston sections connected to opposite sides of said low pressure piston section and extending from said low pressure chamber into an adjacent high pressure chamber for reciprocal movement therein; working fluid inlet-outlet means mounted in fluid communication with said low pressure chamber such that working fluid may alternately work against one side or the other of said low pressure piston section to cause said low pressure—high pressure piston means to reciprocate; and working fluid flow control actuating means for actuating a working fluid flow control means to change the direction of working fluid flow through said working fluid inlet-outlet means, said actuating means including actuating piston means mounted in each end cap bore in fluid communication with said low pressure chamber for reciprocal movement and so constructed and arranged to be shifted from a first, inert position to a second, actuating position by contact with said low pressure piston section and to be returned to said first position by working fluid in said low pressure chamber; each said actuating piston means comprising a shifter pin having an inner end exposed to said low pressure chamber, an outer end extended outward from said end cap, and a mid portion providing a piston face in fluid communication with said low pressure chamber, said shifter pin being so constructed and arranged that the area of said piston face is greater than the area of said inner end whereby pressurized working fluid in said low pressure chamber acting on both said piston face and said inner end will effect movement of said shifter pin into said low pressure chamber; said actuating piston means including a spring-loaded switch-contacting plunger telescopically mounted to the outer end of said shifter pin for actuating contact with a switch when said actuating piston means is shifted to its actuating position.

2. A fluid pressure-intensifying apparatus which comprises a low pressure—high pressure cylinder means providing a cylindrical low pressure chamber and a pair of elongated cylindrical high pressure chambers, the high pressure chambers extending from opposite ends of said low pressure chamber; low pressure—high pressure piston means having a double acting low pressure piston section mounted for reciprocal movement in said low pressure chamber, and having a pair of elongated high pressure piston sections connected to opposite sides of said low pressure piston section and extending from said low pressure chamber into an adjacent high pressure chamber for reciprocal movement therein; cylindrical housing means enclosing and constraining said low pressure—high pressure cylinder means to position and maintain said pressure chambers in alignment; and fluid inlet-outlet means mounted by said housing means in fluid communication with said high pressure chambers to simultaneously introduce fluid to be pressurized to one high pressure chamber and withdraw pressurized fluid from the other high pressure chamber; and working fluid inlet-outlet means mounted in fluid communication with said low pressure chamber such that working fluid may alternately work against one side or the other of said low pressure piston section to cause said low pressure—high pressure piston means to reciprocate.

3. The intensifier of claim 2 wherein said low pressure—high pressure means includes a low pressure cylinder, a pair of end caps fitted to opposite ends of said low pressure cylinder to define said low pressure chamber, and a pair of centering rings; each end cap having a longitudinal passage therethrough for receiving one of said high pressure piston sections for reciprocal movement therein, each such passage being counterbored for containing one of said centering rings; a pair of high pressure cylinders defining said high pressure chambers, each fitted over a portion of one of said centering rings, and fitted to and extending outward from an end cap whereby each centering ring maintains the adjacent high pressure cylinder inner end in alignment with said low pressure cylinder and with said cap longitudinal passage.

4. The intensifier of claim 3 wherein said fluid inlet-outlet means includes a pair of check valve bodies each having a first portion fitted into the outer end of one of said high pressure cylinders and a second portion mounted by said housing means in alignment with said centering rings whereby the adjacent outer ends of said high pressure cylinders are maintained in alignment with said low pressure cylinder.

5. The intensifier of claim 4 wherein said housing means includes a housing cylinder having threaded end sections, and including a pair of threaded retainers each provided with a bore in which one of said valve bodies is fitted, each end retainer being so constructed and arranged to compressively engage an adjacent valve body with the adjacent one of said high pressure cylinders, when said end retainers are screwed to said housing cylinder, with sufficient force to hold together and position the aforesaid intensifier elements under operating conditions.

6. A fluid pressure-intensifying apparatus having a low pressure chamber and a pair of high pressure chambers, the high pressure chambers extending from opposite ends of said low pressure chamber, which comprises an elongated cylindrical housing means enclosing said low and high pressure chambers; a pair of high pressure cylinders positioned within said housing means to provide said high pressure chambers, a pair of end closure means each mounted to an inner end of one of said high pressure cylinders and positioned within said housing means to provide end walls separating said low pressure chamber from said high pressure chambers; low pressure—high pressure piston means having a double acting low pressure piston section mounted for reciprocal movement in said low pressure chamber, and having a pair of elongated high pressure piston sections connected to opposite sides of said low pressure piston section and extending from said low pressure chamber through an adjacent end closure means into an adjacent high pressure chamber for reciprocal movement therein; fluid inlet-outlet means mounted by said housing means in fluid communication with said high pressure chambers to simultaneously introduce fluid to be pressurized to one high pressure chamber and withdraw pressurized fluid from the other high pressure chamber; and working fluid inlet-outlet means mounted in fluid communication with said low pressure chamber such that working fluid may alternately work against one side or the other of said low pressure piston section to cause said low pressure—high pressure piston means to reciprocate.

7. The intensifier of claim 6 wherein said fluid inlet-outlet means includes a pair of check valve bodies each having a first portion fitted into the outer end of one of said high pressure cylinders and a second portion mounted by said housing means in alignment with said centering rings whereby the adjacent outer ends of said high pressure cylinders are maintained in alignment with said low pressure cylinder.

8. The intensifier of claim 7 wherein said housing means includes a housing cylinder having threaded end sections, and including a pair of threaded retainers each provided with a bore in which one of said valve bodies is fitted, each end retainer being so constructed and arranged to compressively engage an adjacent valve body with the adjacent one of said high pressure cylinders, when said end retainers are screwed to said housing cylinder, with sufficient force to hold together and position the aforesaid intensifier elements under operating conditions.

9. The fluid pressure-intensifying apparatus of claim 6 includes working fluid flow control actuating means for actuating a working fluid flow control means to change the direction of working fluid flow through said working fluid inlet-outlet means, said actuating means including actuating piston means mounted in fluid communication with said low pressure chamber for reciprocal movement and so constructed and arranged to be shifted from a first, inert position to a second, actuating position by contact with said low pressure piston section and to be returned to said first position by working fluid in said low pressure chamber.

10. The intensifier of claim 9 wherein said low pressure—high pressure cylinder means includes a pair of low pressure—high pressure cylinder means includes a pair of low pressure chamber end caps defining opposite ends of said low pressure chamber, each end cap being provided with a bore in which an actuating piston means extends.

11. The intensifier of claim 10 wherein each actuating piston means includes a shifter pin having an inner end exposed to said low pressure chamber, an outer end extended outward from said end cap, and a mid portion providing a piston face in fluid communication with said low pressure chamber, said shifter pin being so constructed and arranged that the area of said piston face is greater than the area of said inner end whereby pressurized working fluid in said low pressure chamber acting on both said pistons face and said inner end will effect movement of said shifter pin into said low pressure chamber.

12. The intensifier of claim 11 wherein said actuating piston means includes a spring-loaded switch-contacting plunger telescopically mounted to the outer end of said shifter pin for actuating contact with a switch when said actuating piston means is shifted to its actuating position.

* * * * *